US005265877A

United States Patent [19]

Boylan et al.

[11] Patent Number: 5,265,877

[45] Date of Patent: Nov. 30, 1993

[54] METHOD OF PLAYING A WAGERING GAME

[75] Inventors: Eugene B. Boylan, Zephyr Cove; Anthony J. Delise, Minden; Robert F. Koerner, Gardnerville, all of Nev.

[73] Assignee: BET Technology, Inc., Carson City, Nev.

[21] Appl. No.: 945,404

[22] Filed: Sep. 16, 1992

Related U.S. Application Data

[63] Continuation-in-part of Ser. No. 822,879, Jan. 21, 1992, which is a continuation-in-part of Ser. No. 667,227, Mar. 11, 1991, Pat. No. 5,098,107.

[51] Int. Cl.[5] ..... A63F 3/06

[52] U.S. Cl. ..... 273/139; 273/269; 273/144 B

[58] Field of Search ..... 273/138 R, 292, 269, 273/274, 309, 306, 303-305, 144 R, 144 A, 144 B

[56] References Cited

U.S. PATENT DOCUMENTS

| | | | |
|---|---|---|---|
| 1,361,202 | 12/1920 | Thomas | 273/306 |
| 3,904,208 | 9/1975 | Grossman | 273/146 |
| 4,273,335 | 6/1981 | Allonsius | 273/144 B |

FOREIGN PATENT DOCUMENTS

| | | | |
|---|---|---|---|
| 991386 | 5/1965 | United Kingdom | 273/274 |

OTHER PUBLICATIONS

Games & Puzzles, Gamesview: Bridgette, p. 18, Feb. 1976.

*Primary Examiner*—Benjamin H. Layno
*Attorney, Agent, or Firm*—Larson and Taylor

[57] ABSTRACT

A method of playing a wagering game whose outcome is determined by a selection of winning symbols from a group of usual randomly generated symbols to fill a predetermined number of spots includes at least one additional symbol. The player initially selects a set of player winning symbols and then wagers that a predetermined number of the set of player winning symbols will match those selected. A predetermined number of winning symbols to fill the spots are then randomly selected, including usual winning symbols selected from the group of the usual symbols and, potentially, the additional symbol possibly selected by use of a selection scheme. Thereafter, the wager is settled at one of: a) a first payoff if the additional symbol is not selected and a predetermined number of the set of player winning symbols match the selected usual winning symbols; and b) a second payoff if an additional symbol is selected and a predetermined number of the set of player winning symbols match the selected usual winning symbols. In a preferred embodiment, the adding step includes the adding of a second additional symbol different from the first-mentioned additional symbol so that the wager is settled at different payoffs depending on which one, if any, of the two different additional symbols is selected. The additional symbol can be added to the usual symbols, or to a separate selection device containing other symbols from which the additional symbol may be randomly selected separate from the usual symbols.

8 Claims, 11 Drawing Sheets

142
144
148
CHANCE CARD - DRAW POKER
150
152
149
6
9
GOLD
J
150
164
CHANCE BET PAYOFF
2 GOLD PAY_TO 1
2 SILVER PAY_TO 1
2 BRONZE PAY_TO 1
172
SPECIAL CHANCE BET JACKPOT
2 PLATINUM PAYS
180
CHANCE CARD
INSERT 0 TO 5
WIN
IF NEXT CARD IS
A CHANCE CARD
161
170
163
CHANCE BET=5
160
BET = 4
BANKROLL = 15
156
174a
174b
174c
174d
174e
153
154
HOLD
HOLD
TOKENS
178
PAYOUT
PLAY CREDIT
MAX CREDIT
DEAL
162
158
159
162
146

METHOD OF PLAYING A WAGERING GAME

RELATED APPLICATIONS

This application is a continuation-in-part application of U.S. application Ser. No. 07/822,879 filed Jan. 21, 1992, which in turn is a continuation-in-part application of U.S. application Ser. No. 07/667,227 filed Mar. 11, 1991 and now U.S. Pat. No. 5,098,107.

FIELD OF THE INVENTION

The present invention relates generally to games using symbols in which a wager is made, and more particularly to such games where one or more additional symbols are added and used to determine if an different payoff of a winning wager should be made.

BACKGROUND OF THE INVENTION

Games in which wagers are made based on the outcome of randomly (chance) generated or selected symbols have wide appeal. Such games include various card games as well as other games where there are randomly generated or selected symbols. In order to increase interest in the game, variations to games have been proposed.

For example, in U.S. Pat. No. 4,836,553 and 4,948,134 (Suttle et al.), a modified (for casino play) poker game is disclosed in which each player plays against a dealer. If the player wins, he receives a bonus payment depending on the poker rank of his hand. Both a live version and an electronic version of the game are disclosed.

In U.S. Pat. No. 4,222,572 (Baker), a card deck is disclosed which includes high and low red and black cards. The high cards have indicia thereon so as to be distinguished from the low cards which do not. High cards of a third color are also provided. With this simplified deck, various card games are possible. For example, a player can bet on which card will next be dealt. For this purpose, a suitable game board is also disclosed.

A modified blackjack or 21 game utilizing an additional bet has been licensed by Gaming Concepts, Inc. of Long Beach, CA. In this game, the players may bet not only on the outcome of their hand against the dealer, but they may also bet on whether their first two cards total more or less than thirteen.

While various games have been disclosed to increase interest in a game or to create a new game to generate interest, there has been a need to provide present games with simple and interesting variations to both create additional interest as well as increase wagering opportunities (and hence interest).

SUMMARY OF THE INVENTION

In accordance with the present invention, a method of playing a wagering game whose outcome is determined by a selection of winning symbols from a group of usual randomly generated symbols of that game to fill a predetermined number of spots is provided. In the method, at least one additional symbol is added to the game. The game is then played by at least one player, and possibly a large plurality of players. In playing the game, the player initially selects a set of player winning symbols from the usual symbols, which set contains less player winning symbols than the number of spots. The player then wagers on a usual play of the game that a predetermined number of the symbols of the set of player winning symbols will match the selected winning symbols. Subsequent to the wagering step, a predetermined number of winning symbols to fill the spots are randomly selected, including usual winning symbols selected from the group of the usual symbols and, potentially, the additional symbol possibly selected by use of a selection means for randomly selecting the additional symbol from a plurality of other symbols. Thus, it will be appreciated that the selected winning symbols for all of the spots may or may not include the additional symbol. Thereafter, the wager is settled at one of: a) a first payoff if the additional symbol is not selected and a predetermined number of the symbols of the set of player winning symbols match the selected usual winning symbols; and b) a second payoff if an additional symbol is selected and a predetermined number of the symbols of the set of player winning symbols match the selected usual winning symbols.

In a preferred embodiment of the method of the present invention, the adding step includes the adding of a second additional symbol different from the first-mentioned additional symbol. Then, the settling step for the second payoff includes the settling of the wager at different payoffs depending on which one of the two different additional symbols is selected.

In another preferred embodiment, the spots are provided in a predetermined order. Then, the settling step for the second payoff includes the settling of the wager at different payoffs depending on which one of the different spots is filled with the additional symbol.

In one embodiment, the adding step includes the adding of the additional symbol to the usual symbols. Alternatively, the adding step includes the adding of the additional symbol to a separate selection means containing other symbols from which the additional symbol may be randomly selected separate from the usual symbols.

Preferably, the wagering game is a lottery type of game with the usual symbols including numbered balls and with the additional symbol being a non-numbered ball. In addition, the participants of the game include at least one player and a house against which each player wagers so that the settling step is performed by the house.

It is an object of the present invention to provide a wagering game which generates increased interest and participation.

It is also an object of the present invention to provide a wagering game with an opportunity for increasing the winnings.

It is another object of the present invention to provide a wagering game which achieves the above-noted objects and in addition is simple and easily understood as an addition to a usual wagering game.

Other features and objects of the present invention are stated in or are apparent from a detailed description of presently preferred embodiments of the invention found hereinbelow.

DETAILED DESCRIPTION OF THE PREFERRED EMBODIMENTS

Figure 1:
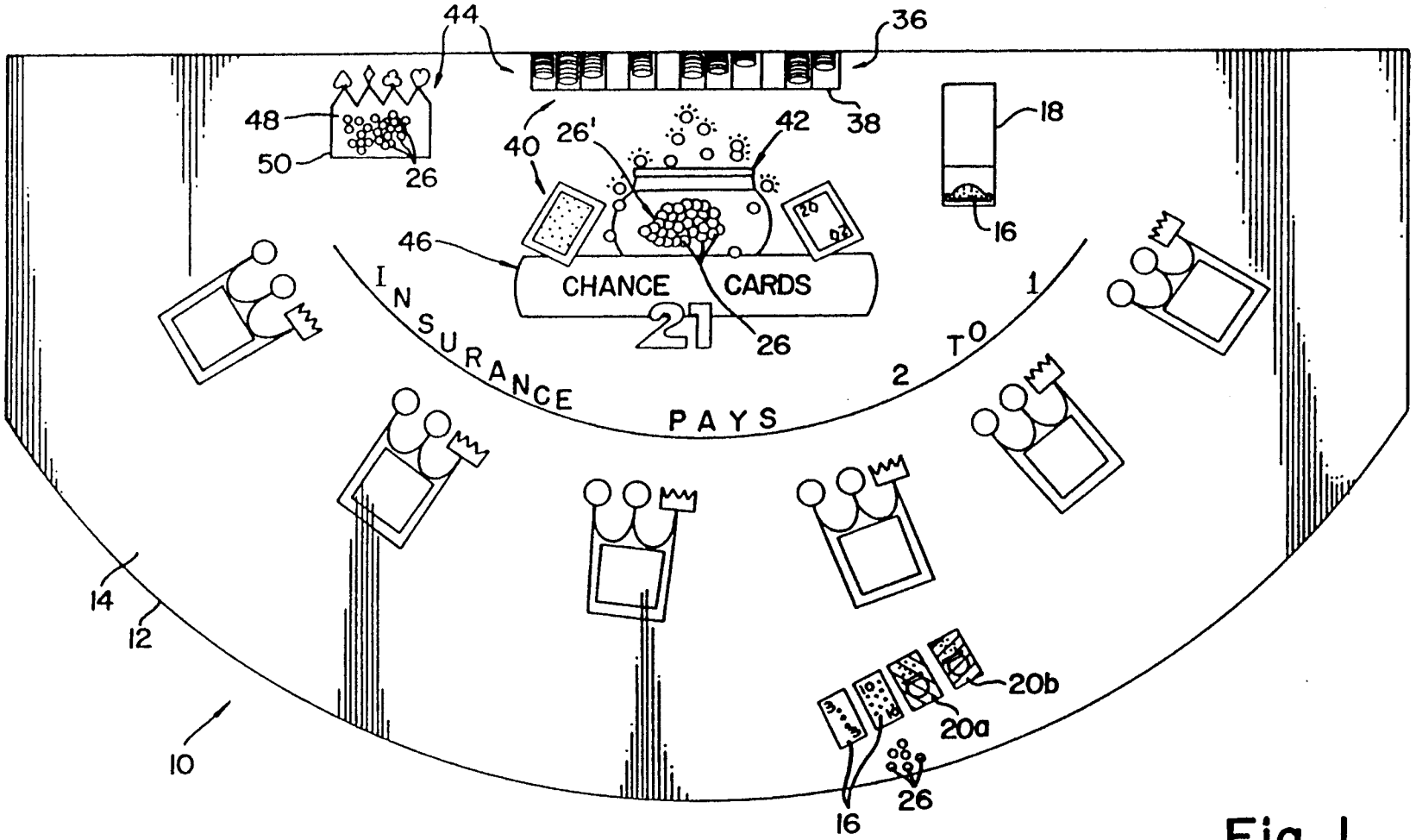
FIG. 1 is a schematic representation of a display surface for a 21 wagering game of the present invention.

With reference now to the drawings in which like numerals represent like elements, a playing system 10 is depicted in FIG. 1 for playing a wagering game in accordance with the present invention. Playing system 10 includes a display means 12 for this wagering game. It should initially be appreciated that playing system 10 is adaptable for use either as a casino operator's live action table or as a home playing board. Thus, display means 12 could either be a top surface of a table and thus serve as a permanent structure for a live action table game or as a board, sheet, or velcro elements for use in a portable home game. As such, it will be appreciated that display means 12 in all cases includes a surface 14 which is viewable by the various participants (player(s), dealer, and/or house).

Playing system 10 is designed, in this particular embodiment, to provide for the playing of a usual game of 21 or blackjack. As such, playing system 10 includes the usual symbols for the 21 game, that is a plurality of value playing cards 16. For convenience, and as is typical in a live action game, playing cards 16 are contained in a shoe 18 which contains a number of decks of playing cards 16 all mixed together so that as the cards are dealt each dealt card is randomly generated. The cards are dealt face up with the exception of a hold card for the dealer.

In addition to the usual symbols of the game (playing cards 16), a plurality of additional symbols are added to the usual symbols. In this embodiment, the additional symbols are at least two no value playing cards 20*a* and 20*b*. As shown in FIG. 1, no value playing cards 20*a* and 20*b* are easily identifiable (on the value side, the other side of all cards being the same), such as by suitable indicia provided thereon. Further, in a preferred embodiment of playing system 10, no value playing cards 20*a* and 20*b* also come in variety of colors, such as gold and silver (which different colors are shown in FIG. 1 by different cross hatching).

As well known, the usual 21 game provides a wagering opportunity between the participants (typically a number of players each playing against a dealer) on who will be closer to the sum of 21 without exceeding the sum of 21. In order to provide a usual wagering means 22 for making such a wager, surface 14 is provided with an indicia 24 on which a wagering token 26 (such as a chip, money, coin, bill, paper, or other item chosen to have a value) is placed to indicate that a usual wager has been made. As shown best in FIG. 2, indicia 24 is a circle with the lettering "21 bet" contained therein. Before commencing each hand, as in the usual 21 game, each player is required to place a wagering token 26 in the usual wagering means 22 to indicate that this player is participating in the next hand.

As mentioned above, a plurality of no value playing cards 20*a* and 20*b* are mixed with regular value playing cards 16. Display means 12 thus also includes a chance wagering means 28 including indicia 30 whereby each player can also wager by the placing of a suitable wagering token 26 on indicia 30 that two no value playing cards 20*a* and/or 20*b* will be dealt consecutively during that hand or round of play.

In this embodiment of playing system 10, display means 12 further include an association wagering means 32 including indicia 34. Association wagering means 32 is used to make a wager by the placing of suitable wagering token 26 thereon when a player desires to also wager that the first two playing cards 16 dealt to that player will have some predetermined association. In this embodiment, as indicated by indicia 31, the predetermined association is for two cards of the same suit or for a "king" and "queen".

As playing system 10 depicted in FIG. 1 is designed for a 21 game having a dealer and from 1 to 6 players, each player thus plays against the dealer. The dealer is therefore supplied with a usual settling means 36 which in this embodiment takes the form of a bank 38 of wagering tokens 26 (which are conveniently of various denominations as desired). Thus, if the player loses, the player settles or pays by the loss of his wagering tokens 26 placed on indicia 24, typically by the collection of such tokens 26 by the dealer and placing of these tokens 26 into bank 38. Conversely, if the player wins against the dealer, the dealer simply settles or pays the player from tokens in bank 38.

Figure 2:
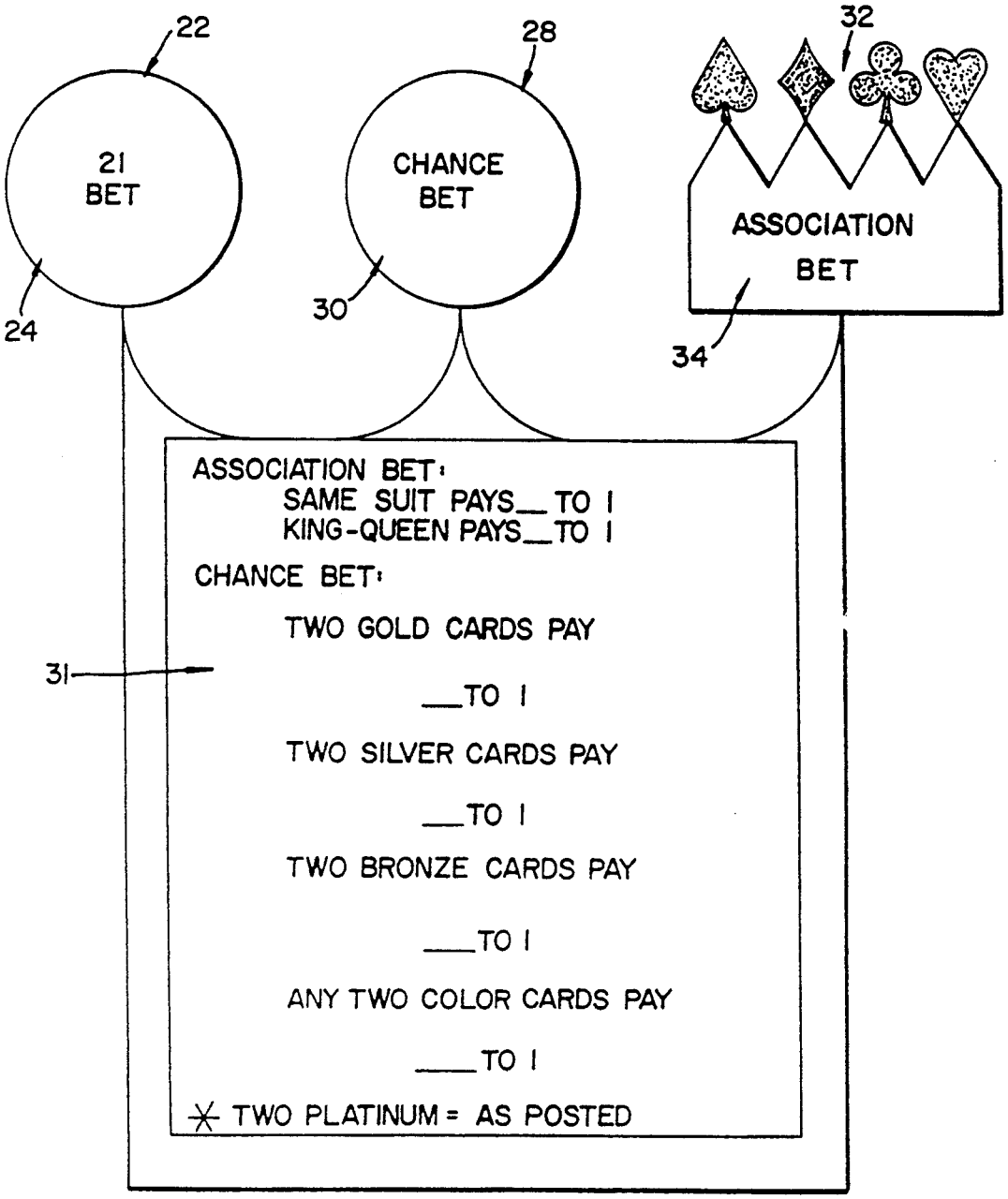
FIG. 2 is an enlarged view of one of the wagering indicia shown in FIG. 1.

In order to pay off chance wagers made on indica 30, a chance settling means 40 is also required. With playing system 10, chance settling means 40 includes bank 38 as well as an indicia 42 on which a plurality or pot 26' of tokens 26 is provided. Depending on the method of playing the 21 game (different versions are discussed subsequently), all or some portion of tokens 26 in pot 26' contained on indicia 42 are paid to a player making and then winning a chance bet. Where the player loses a chance bet, tokens 26 placed on indicia 30 are then preferably collected by (settled to) the dealer and added to bank 38 and/or chance settling means 40. It should be appreciated that the provision of a separate chance settling means 40 is desired to stimulate interest in a chance bet, but that chance settling means 40 could also simply include bank 38 without the necessity for a separate pot 26' of tokens 26 provided on indicia 42.

Where the chance settling means includes bank 38 and does not make use of pot 26' of tokens 26 at indicia 42, suitable indicia 31 is provided indicating payoffs for the various chance bets available. Indicia 31 is provided adjacent wagering means 22, 28, and 32 as depicted in FIG. 2. Indicia 31 thus shows payoffs for various no value playing cards combinations, and in FIG. 2 it is further evident that no value playing cards include bronze cards as well as gold and silver cards 20*a* and 20*b*.

Where an association bet is made with association wagering means 32, an association settling means 44 simply takes the same form as usual settling means 36. Thus, settling is accomplished as losing bets are collected by (paid off to) the dealer and applied to bank 38 while winning bets of the player are paid from bank 38.

To further stimulate interest in making a chance wager in casinos and the like, a progressive chance jackpot (not shown) could also be used. Such a progressive jackpot could be funded by the pooling of a small percentage of all lost chance wagers from a number of tables. Thus, the progressive jackpot would become increasing large (until won), and all players at the various tables would be eligible to make a chance wager to win this progressive jackpot. Preferably, the value of the progressive jackpot would be posted at various places for the players to see, as indicated in indicia 31. This would conveniently be done using video displays, which could be continuously updated by meters which the dealer at each table would continually update. To win the progressive jackpot, a player would have to receive two particular no value cards of an extremely rare type. For example, two no value cards of a platinum color could be mixed into six regular decks of value playing cards.

In some jurisdictions, it may also be required that some portion of any value of tokens 26 remaining in indicia 42 when a table closes be ultimately distributed to some wagering player(s). In such situations, the required portion of the value remaining in indicia could also be added to a progressive jackpot. Thus, the required portion would eventually be returned to a wagering player, as required. This could be done in addition to the adding of a portion of lost chance bets to the progressive jackpot, or as an alternative way of funding the progressive jackpot.

From the above description, it should be evident that a number of versions of a wagering game of the present invention based on a usual 21 or blackjack game is possible. With reference to FIGS. 1 and 2, some of these various versions will be discussed subsequently in detail. It will be appreciated that the variations occur within the usual playing of the 21 or blackjack game and the usual wagering thereon. Thus, as a prerequisite for participation, each player must initially wager a usual 21 bet, which is usually of a predetermined minimum amount.

Version 1

In a first version of the 21 wagering game of the present invention, chance wagering means 28 is utilized. When any player is dealt a no value playing card during normal play, normal play is momentarily suspended. The dealer then requests that any player desiring to make a chance wager place an appropriate wager (usually of a predetermined minimum) on indicia 30. After the wagers have been made, the next card is drawn from shoe 18. If it is another no value playing card, the players with bets are winners and the dealer pays off the winning bets as indicated by indicia 31. However, if it is not a no value playing card but rather a value playing card, the player who drew the original no value playing card then takes the value card in place of the no value card received. The dealer then collects all losing chance bets. In the preferred embodiment of playing system 10 and for the reason as discussed subsequently, half of all of the losing bets collected by the dealer are placed in bank 38 while the other half are added to pot 26' of tokens 26 in chance settling means 40. Thereafter, normal 21 play resumes until another no value card is dealt to a qualifying player.

It should be appreciated that a predetermined number of no value playing cards are mixed in with regular playing cards 16. For example, a minimum of two each of gold no value playing cards 20*a*, silver no shown) are mixed in with each deck of playing cards 16 provided in shoe 18.

In this version, the dealer does not participate in the chance wagering sequence. Thus, if the dealer receives a no value card, it is immediately discarded and the dealer then draws a new card from shoe 18 until a value card is received. With this version, it will also be appreciated that the dealer must immediately check any down card received to make sure that it is not a no value card.

In order to stimulate participation in making chance bets, according to this version of the wagering game of the present invention, the player who receives the first no value card is also eligible to win pot 26' of tokens 26 provided in indicia 42 when that player does make a chance bet. The receiving player of a first no value card of a certain color, such as gold no value card 20*a*, by making a chance bet, can then win all of the tokens 26 in indicia 42 if the subsequent card dealt is a no value card of the same color, i.e. another gold no value card 20*a*. As mentioned above, half of all losing chance bets are added to pot 26' of tokens 26 in indicia 42, so that there is an increasing payoff should the receiving player make and win such a chance bet.

With this version, it should be appreciated that even if a player has already lost his 21 hand during that round of play, he is still able to make a chance bet when another player receives a no value card. Thus, the use of a chance bet helps to maintain the interest of all players in the entire round of play.

It should also be appreciated that as it is possible for a number of chance bets to be made during a round of play, all chance bets must be immediately paid or collected by the dealer before normal play resumes in case a no value card is subsequently dealt.

While there is no requirement that any player make a chance bet when a no value card is dealt, because the no value card has no value, it is also necessary that further cards be dealt to that same player until a value card is received in order to continue normal playing.

With this version, the dealer or house in a casino type game can determine minimum and/or maximum bets. Regular 21 insurance could also be used, if desired. Further, the chance bet payoffs may also be determined by the house or dealer as desired and as consistent with any local laws. It should also be appreciated that where ½ of losing chance bets are added to pot 26', it may be desirable to have special ½ value tokens. Thus, where a player makes an odd chance wager such as three tokens, it is possible for the house of dealer to easily add 1 ½ tokens to pot 26'. Obviously, players would not be permitted to make any wagers including only a single ½ token, and for convenience would preferably not be able to use any ½ tokens but would instead redeem any ½ tokens won in pot 26' for regular tokens.

In a home version of this type of game, there would be no house dealer and each player would deal in turn. While a player is dealing, the dealer would then not be eligible to make any chance wagers. Further, only the player receiving the no value card would have an opportunity to place a chance wager upon receipt of the first no value playing card. All lost chance wagers would be placed in a pot of tokens in a chance settling means to build up the chance settling means. When the game is first started or after the chance settling means has been depleted, an "ante" of a predetermined amount would be required from each player. In addition, where different matches of no value playing cards is possible, a predetermined percentage of the pot of tokens in the chance settling means would be won by a successful chance bet.

Version 2

In a second version of a wagering game of the present invention, the method of play is essentially the same as described in Version 1 above. However, in this version, the player receiving the first no value card can win pot 26' of tokens 26 in indicia 42 simply by receiving a second no value card of any color. Thus, in this version, no color match of no value cards is necessary to win pot 26' of tokens 26 in indicia 42.

Version 3

The method of playing this version of a wagering game according to the present invention is also basically similar to that of Version 1 above. However, in this version, there is no pot 26' of tokens 26 in indicia 42 and the payoffs for a chance bet are simply as indicated in indicia 31. In addition, if a no value card is received by the dealer, all players (the dealer is not considered a player) can make a chance bet at that time if desired. The next card from shoe 18 would then be dealt to the dealer and all chance bets made by the players would be settled depending on the card dealt just as in the case of a player receiving a no value card.

Version 4

In this version of a wagering game according to the present invention, the same method of play discussed above with respect to Version 1 applies. However, in this version, a player receiving a no value card would only qualify to win pot 26' of tokens 26 in indicia 42 if the receiving player makes a predetermined maximum chance wager. Then, if the receiving player subsequently receives a second no value card of the same color, the receiving player would win the entire pot 26' of tokens 26 in indicia 42. Otherwise, if the receiving player does not make the maximum wager or no wager at all, the payoffs would be as described above in indicia 31 in Version 1 for that player and the other players.

Version 5

In this version, the same method of play described above in Version 1 also applies. However, a player receiving a no value card must first make an election either to purchase the no value card at some predetermined price determined by the dealer or house. A purchased no value card can then be substituted for a value card in that player's hand at the player's discretion. When a no value card is purchased by a player in this manner, no chance bets are made, and usual play will continue with a new card being dealt from shoe 18 in the usual manner of play. Otherwise, the usual opportunities for chance wagering would occur if the card is not purchased by the receiving player.

Version 6

The method of play of this version is also basically the same as in Version 1. However, in this version, any chance bets would be made prior to the dealing of any cards. Thus, any chance bets would also be made at the same time as usual bets. As the players would not be assured that any no value cards would be dealt during usual play, the payoff for winning of a chance bet would be increased compared to that of Version 1 to compensate for this increased risk to the player. Also, after a no value card and a subsequent card are dealt and any chance wagers settled, any subsequently dealt no value cards in that hand would be ignored and a new card immediately dealt to replace it.

Version 7

This version of the wagering game is also basically similar to the first version discussed above, but in this case a chance display area 46 is designated on surface 14. Then, when a no value playing card is dealt, the no value card is moved to chance display area 46 and the players are invited to make chance bets. The next card dealt is then also placed in the chance area for all players to see with ease. If it is not another no value card, the playing card 16 is then given to the player who initially received the first no value playing card and all bets are collected by the dealer or house. In this version, there is only a payoff as indicated in indicia 31, and thus pot 26' of tokens 26 in indicia 42 is omitted in this version. If a second no value playing card is dealt, payoffs are made as indicated in indicia 31.

By way of example in this version, where six standard decks of playing cards 16 are used, there can be four gold no value playing cards 28, twelve silver no value playing cards **20*b***, and twenty bronze no value cards mixed together with the six standard decks. In this example, a suitable payoff value would be: for two gold no value playing cards, 25 to 1; for two no value silver playing cards, 20 to 1; for two bronze no value playing cards, 10 to 1; and for any two no value playing cards of any color, 3 to 1. For the four payoff occurrences, the odds are, respectively, 1,040 to 1; 93.64 to 1; 31.87 to 1; and 15.97 to 1. Where the house retains all losing bets, the house whole percentage would be 18.28 while the player return percentage would be 81.72.

Version 8

The method of play of this version is also basically similar to that of Version 1 above. However, in this embodiment, if the dealer receives a first no value playing card, the players can make chance wagers as desired. However, the payoffs for the chance wagers will be limited to that indicated by indicia 31. Thus, there will be no possibility of any of the players winning pot 26' of tokens 26 in indicia 42.

Version 9

The method of play of this embodiment of the wagering game according to the present invention can use any of the versions mentioned above. In addition to the use of the additional no value playing cards, association wagering means 32 is further utilized. To use association wagering means 32, at the same time that a usual 21 bet is made by placing a token on usual wagering means 22, an association bet is also made by using association wagering means 32 and placing one or more tokens 26 thereon. The association wager is that the first two cards dealt to that player will have a predetermined association. In the embodiment of association wagering means depicted in FIG. 2, the predetermined association is indicated by indicia 31. This predetermined association and associated pay off is that the first two cards are of the same suit. As an added bonus, an additional payoff is made if the two cards are not only of the same suit, but are also (or alternatively, if desired) a king-queen combination. Thus, after the first two cards are dealt to each player, the dealer then immediately settles any association wagers according to the payoff indicated in indicia 31.

As another embodiment of this version, it is also possible for the house or dealer to contribute one-half of all losing association wagers to a separate association pot 48 of association settling means 44 provided in indicia 50. Association pot 48 would be used to pay off a winner of a king-queen combination of the same suit from what should be an increasingly valued pot of tokens. The house or dealer could guarantee a minimum amount in association pot 48 for the occasions after association pot 48 is paid out and before a minimum amount is collected and placed therein by losing association wagers. If desired, the kings and queens of the decks of cards 16 can also be specially designated to facilitate the ready recognition thereof and to indicate that these cards are used with association wagering means 34 to help stimulate interest in association wagering means 34.

While playing system 10 has been illustrated with use of the 21 or blackjack usual card game, it should be appreciated that various other usual card games can also make use of chance wagering means 28 and association wagering means 32. Thus, card games such as poker, baccarat, and pai gow can incorporate no value playing cards and the various versions of the 21 or blackjack game discussed above adapted for use with these other games. By way of further example, the following additional versions of a wagering game are discussed hereinafter.

Version 1

For a casino table game stud poker version, the display means would be essentially similar to display means 12. Then, during any of the versions of stud poker as each card is dealt the receiving player or dealer must immediately check each down card. If a no value card is received, the card is then moved to a central area and regular poker play is suspended while chance wagers are made and settled. If the no value playing card initially received was a down card, then the subsequent card dealt will also be a down card and the dealer must check it upon dealing. If the subsequent card is another no value playing card, the card is turned over and winners paid accordingly. However, if the subsequent card is a regular playing card, the regular playing card is then passed to the player without revealing it to the other players.

Version 2

In the draw poker version of a method of playing a wagering game according to the present invention, all players will make a usual wager prior to dealing and a chance wager also at that time if desired. Subsequently, if a player has not made a chance wager, any no value card received by that player is simply replaced by the dealer.

However, if the receiving player had already placed a chance wager, the following would occur. If the receiving player is dealt only one no value playing card, it will be considered as a "joker". In "high" draw poker, the single no value playing card is used only as an ace or a fill-in card in straights and flushes. However, in "low" draw poker, the single no value playing card is used as a fill-in card. Obviously, other variations on this theme can be designated by the house or rules. If the player is dealt two or more no value playing cards, the receiving player must then redeem two of these no value cards immediately and the chance wager will be settled according to posted payoff schedules (including color match, etc.). Two new cards will then be dealt to replace the two no value cards turned in. After turning in the first two no value playing cards, if the player still has remaining no value playing cards, a single remaining no value playing card is then used as a "joker" or two remaining no value playing cards are then turned in and settled as a separate successful chance wager. After all no value playing cards have been redeemed, the usual betting and draw rules are then followed. During the draw, the above rules apply when a further no value playing card is received. At the end of the hand, any chance wagers remaining for players who did not receive two no value playing cards are then collected by the house (and optionally one-half provided to a pile for a chance settling means pot).

For a home version of such a game, it is anticipated that there would be no house dealer, and all players would deal in turn. In this event, all chance wagers which are lost would be placed into a chance settling means. The chance settling means would also require an "ante" when the game is first started or after the pile of tokens in the chance settling means has been won. Where color no value cards are used, different percentages of the chance settling means would be won depending upon the presence and color of matches.

The various versions discussed above are also applicable to a usual baccarat card game. In one preferred embodiment, the usual baccarat game would be played until a no value playing card is dealt. This card would then immediately be moved to a display area and chance wagering would occur by any player desiring to do so. If another no value card is next dealt, all players making chance wagers would be winners and such wagers settled by the dealer. In addition, if the receiving player has made a chance wager, the receiving player would also win at least some portion of a pot of tokens in a chance settling means in the same manner as described above.

In this version of a baccarat game, a receiving player may make a chance wager even if their usual baccarat wager is on an opposite hand. By way of example, there could be eight standard decks of playing cards to which is added: six gold no value cards, 14 silver no value cards, and 28 bronze no value cards. Exemplary payoffs would then be: for two gold no value cards, 25 to 1; for two silver no value playing cards, 10 to 1; for two bronze no value cards, 5 to 1; and for any two no value cards, 1 to 1. With such pay outs, a house hold percentage would be about 11% while the player return percentage would be about 89%.

As with the 21 game discussed above, it would also be possible to utilize an association settling means in a baccarat game in a similar manner as discussed above.

Both wagers for any two cards of the same suit or for a higher payoff for the king and queen in a suit could be made as discussed above. In addition, a separate association settling means could be won by a player who makes an association bet and further wins that bet with a natural 9 using the two cards in the suit first dealt.

A wagering game according to the present invention could also include the usual game of pai gow poker. In such a game, all cards are dealt face-up, so the method of play would be similar to that described above for 21 or blackjack. In a preferred embodiment of a pai gow game according to the present invention, essentially the same rules as described above with respect to version 8 of a 21 game would be used.

For home versions of any of the above wagering games, an appropriate playing system would be provided. Such a system would include a table layout, a tray of assorted wagering chips or tokens, and two decks of playing cards including an appropriate number and type of no value playing cards. In addition, for convenience, a number, such as one dozen, of Velcro-backed chance wagering means and association wagering means in the forms of circles with suitable indicia thereon would be provided to be attached to the table layout in front of each player. A set of appropriate rules for the home version game would then also be provided.

Figure 3:
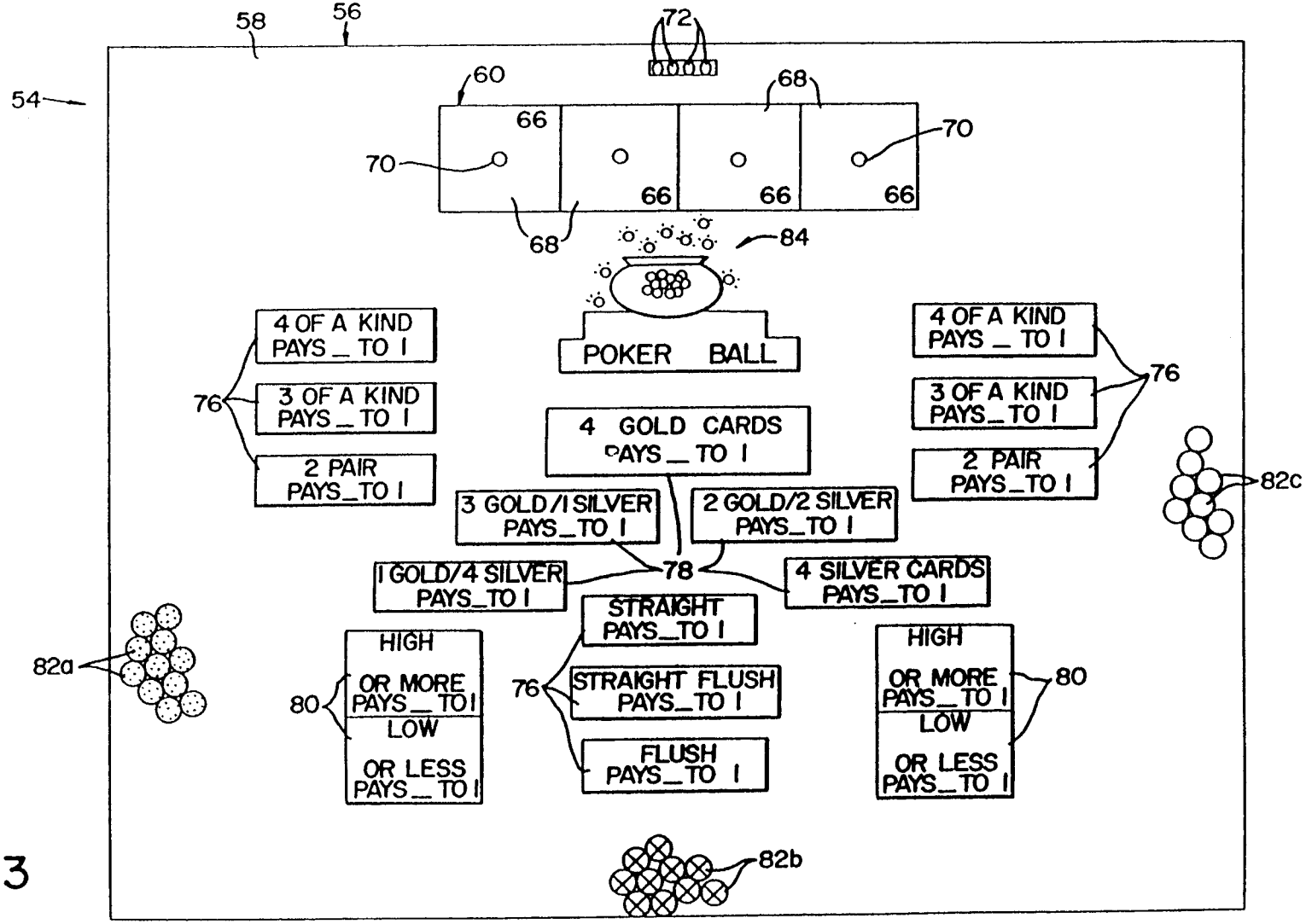
FIG. 3 is a schematic representation of a display device for a poker ball wagering game of the present invention.
Figure 4:
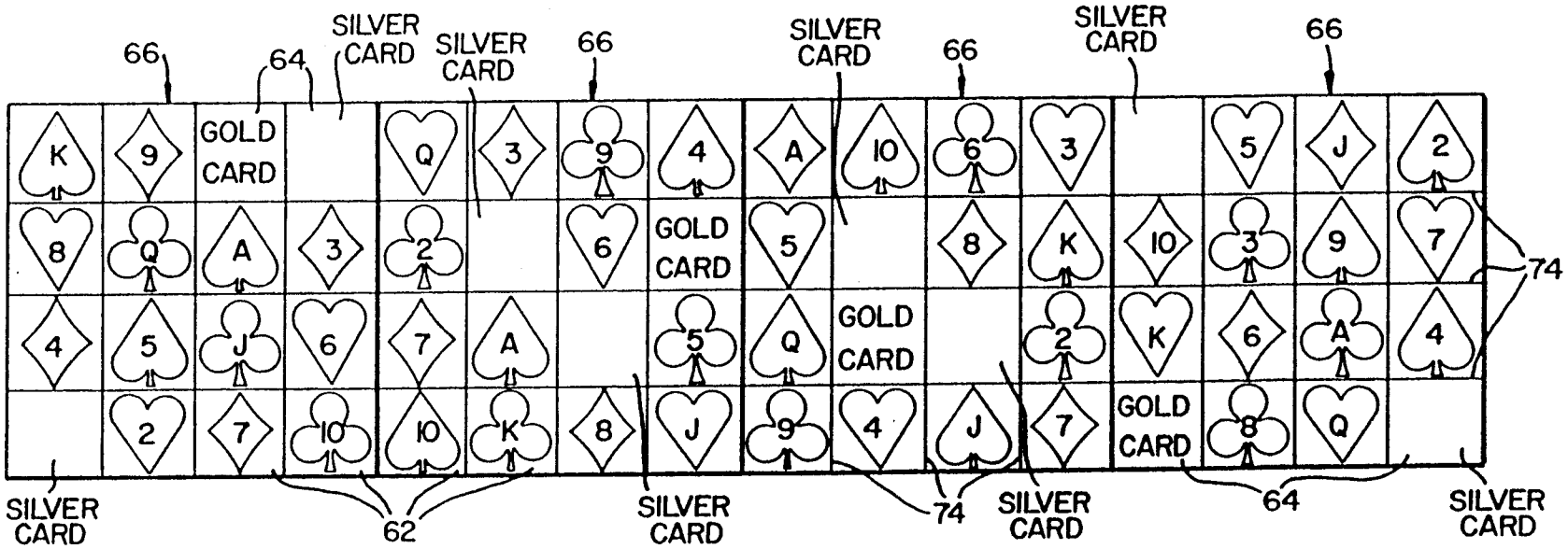
FIG. 4 is an enlarged view of the symbols contained in the box of FIG. 3 and omitted therein for clarity.

Depicted in FIG. 3 is a second embodiment of a wagering game according to the present invention including a playing system 54. Playing system 54 includes a display means 56 having a surface 58. This wagering game is similar to a poker card game, but instead of playing cards, there is a selection device 60 whereby representations 62 of usual playing cards as depicted in FIG. 4 are selected. As shown, there are also representations 64 of no value playing cards as well. Selection device 60 in this embodiment includes a series of clear boxes or containers 66 having tops 68 in which a single aperture 70 is provided. As there are four containers 66, four balls 72 are also provided with playing system 54. It will thus be appreciated that in playing the wagering game, a ball 72 is dropped through each aperture 70 of selection device 60. Then, because representations 62 and 64 are formed on a hard surface with borders 74 therebetween, each ball 72 in a container 66 will bounce around and finally come to rest upon (randomly select) one of representations 62 or 64.

As shown in FIG. 3, surface 58 includes various indicia 76 whereby a usual wager is made on the outcome of the representations 62 selected by the dropping of balls 72 into container 66. As mentioned above, this game is similar to poker and thus some of the poker-type hands can be bet on with different payoffs depending on the difficulty of selecting such a hand. It will be appreciated that in this wagering game, there are only four containers and thus only four representations selected.

In addition to the usual wagering means provided by indicia 76, chance wagering means in the form of indicia 78 are further provided. Indicia 78 also is similar to the chance wagering means described above, with the occurrence of various representations 64 generating different payoffs depending upon the difficulty of obtaining such combinations or representations.

Finally, an association wagering means in the form of indicia 80 is further provided. In this embodiment, the association is the sum of the selected representations 62 (and 64, but having no value these can be ignored). Depending upon the number value of representations 62 selected, a predetermined payoff can be obtained if the sum of the number values of representations 62 is above a certain "high" value or less than a certain "low" value.

With playing system 54, all of the players utilize the same indicia 76, 78, and 80. For that reason, playing system 54 also includes different kinds of tokens such as tokens **82*a*, 82*b* and 82*c***. Thus, the wager that each player makes is identified by his particular variety of token, and any winning wagers must therefore be settled in a similar token which would be maintained by the dealer or house.

The method of play of the wagering game of playing system 54 is, obviously, subject to a number of versions as described above with respect to the other games. In one preferred embodiment, the method of play would be as follows. At the start of each game, all players are given an opportunity to place a bet on one or any number of indicia 76, 78 and 80. After the bets are made, balls 72 are dropped into respective containers house or dealer such that a representation 62 or 64 in each container 66 is randomly selected when balls 72 come to rest thereon. Depending on the various representations selected, the various wagers of the players are settled either by collection of the losing wagers or paying off of winning wagers by the dealer or house. Thereafter, a new game is commenced with the players making any wagers desired.

As with other versions of a wagering game described above, a separate chance settling means 84 can be provided in which half of all losing chance wagers are placed to form a pot which can be won by a preselected bet such as the appearance of four gold no value cards. In case of ties, the pot would be split amongst the bettors.

Playing system 54 is also easily adapted for a home version in a manner similar to that described above for other wagering games.

Figure 5:
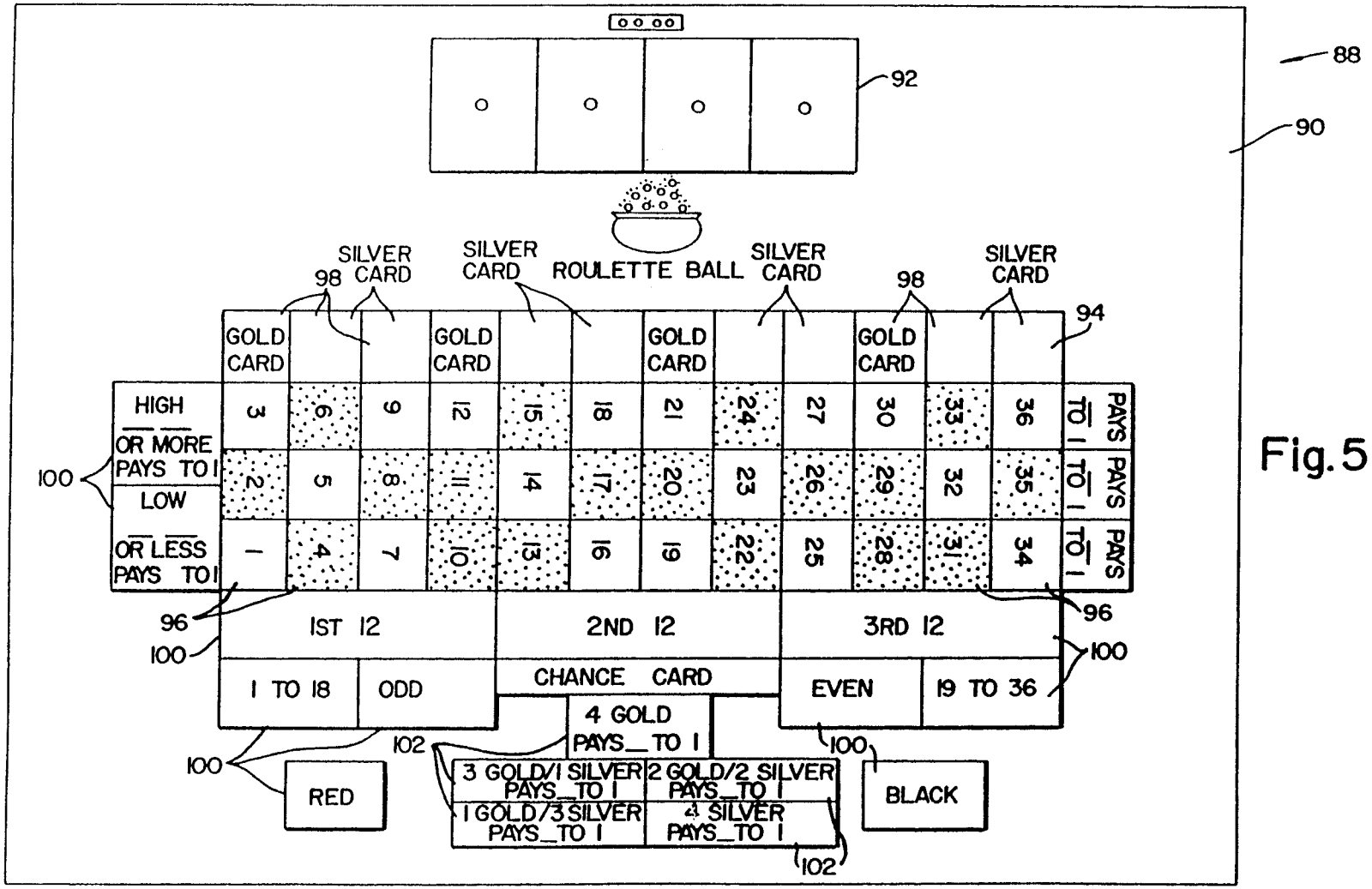
FIG. 5 is a schematic representation of a display device for a roulette ball wagering game of the present invention.

Depicted in FIG. 5 is a playing system 88 which is broadly similar to playing system 54. Playing system 88 is for a game similar to a ball roulette. Playing system 88 thus includes a surface 90 on which a clear selection device 92 is provided having representations therein (not shown) which are laid out in the same manner as a grid 94 provided on surface 90. Grid 94 thus includes similar representations 96 corresponding to the usual numbers of a usual roulette ball game as well as representations 98 for no value "cards" or selections in the colors noted. It should also be appreciated that representations 96 of the numbers also show red and black colors, with the black colors appearing as shaded in FIG. 5.

Surrounding grid 94 is various indica 100 forming usual wagering means for the outcome of representations 96 of the usual numbers. In addition, indicia 102 is further provided for wagering on the chance selection of a plurality of indicia 102 representing no value cards.

As with playing system 54 discussed above, playing system 88 is used in a similar manner. Thus, at the start of each game, new players are given the opportunity to place the various bets or plurality of bets as desired using indicia 100 and 102. To distinguish each player, each player has different colored wagering chips or tokens. Then, at the end of each game, the various bets are settled as required. As with playing systems 10 and 54, a chance settling means 104 can also be provided containing half of all of the lost chance wagers from previous games. The pot contained in chance settling means 104 would be won by a bet of four gold cards.

Figure 6:
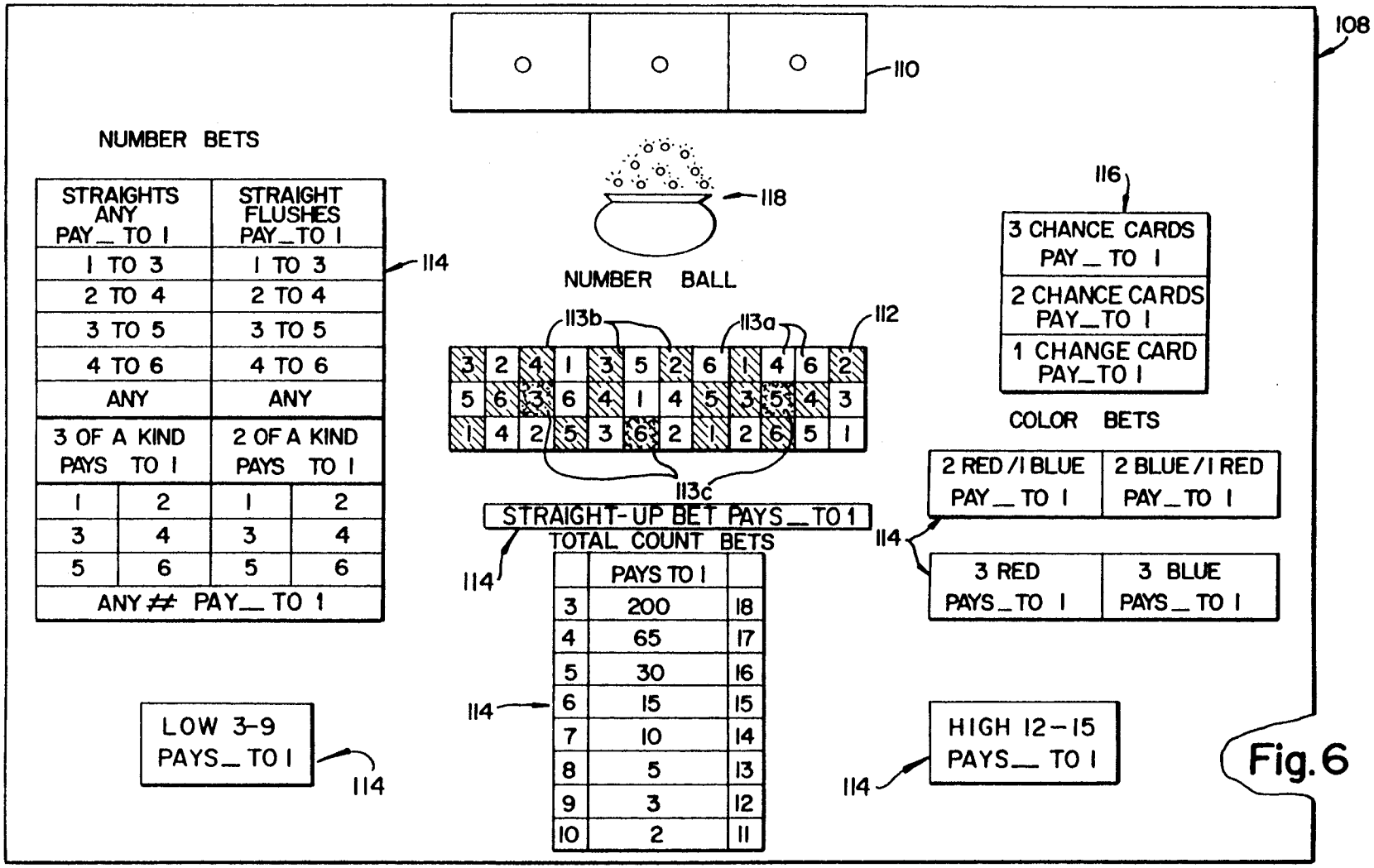
FIG. 6 is a schematic representation of a display device for a number ball wagering game of the present invention.

Depicted in FIG. 6 is another playing system 108 for an alternative wagering game according to the present invention. This wagering game is based on the selection of certain numbers or "cards" in a clear selection device 110 containing representations of numbers (not shown) as shown in grid 112. As shown in grid 112, various numbers are individually represented, and additionally various numbers are color-coded as red or blue (in grid 112, red numbers are represented by plain squares 113*a* while blue numbers are represented by squares 113*b* having diagonal lines therein). In addition, certain squares 113*c* in each 3×4 matrix of a container are also designated as chance "cards" or numbers. In grid 112, these chance numbers are represented by numbers surrounded by dots, though in an actual grid these numbers would probably be colored gold or some similar color.

It will thus be appreciated that playing system 108 includes indicia 114 for various usual number bets, many of which in this case are similar to poker bets, though without any face cards or suits but including colors. Other bets include the totals of the selected numbers being between certain LOW values or between certain HIGH values. Similarly, an indicia 116 is provided for a chance wagering means, which can pay off if one or more chance cards are selected as indicated.

The method of playing the wagering game of playing system 108 is basically the same as described above for playing systems 54 and 88, and a chance settling means 118 may also be provided.

Figure 7:
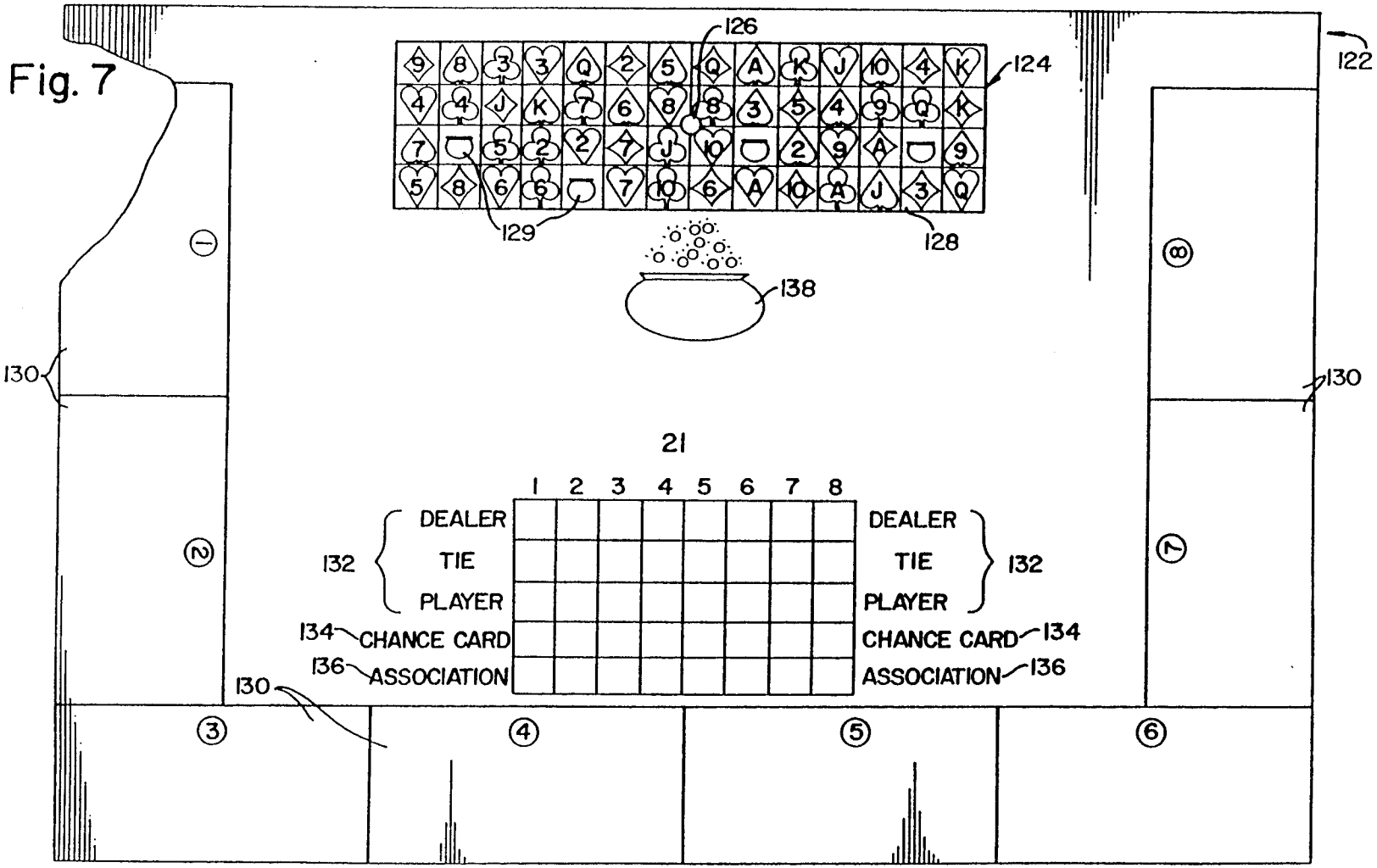
FIG. 7 is a schematic representation of a display device for a 21 ball wagering game of the present invention.

Depicted in FIG. 7 is a playing system 122 which utilizes a selection device 124 similar to the selection devices described above. Selection device 124, however, has a single aperture 126 through which balls (not shown) are sequentially dropped to represent the dealing of cards from a deck of usual playing cards as indicated in grid 128 located in selection device 124. Playing system 122 includes areas 130 for eight players to sit adjacent as well as an area for the dealer behind selection device 124.

Playing system 122 makes use of the usual game of 21, but in playing system 122 the game is only between a house dealer and a single "house" player who may or may not be designated. Balls are sequentially dropped into selection device 124 to represent the dealings of cards to the house player and the house dealer, in the usual manner of 21 play. In playing system 122, it will be appreciated that the house player is required to select a hit card should the total of the first two cards be below a predetermined minimum (for example 15) and that the house dealer is similarly be required to select an additional card should the dealer's total be below a predetermined minimum (for example 16). If desired, one of the eight players can be selected for each hand to drop the house player's balls or all of the balls as desired. Alternatively, all players can sequentially drop the balls, or just the player's balls.

Before each hand, the players can bet on the three possible outcomes of a hand as indicated by indicia 132. These outcomes are that the house dealer wins, that there is a tie, or that the house player wins. Different rows are provided for each player to make a bet, and for convenience each player can also be provided with different color chips to distinguish that players'bet from other players' bets. In addition, each player can also bet on whether two chance cards 129 will be selected consecutively as indicated at indicia 134 and additionally bet on whether a predetermined association (such as a same suit) will occur with the first two house player cards selected by use of indicia 136. Obviously, the various versions of a 21 or blackjack game discussed above for use with the present invention are also applicable to playing system 122, including a chance settling means 138.

Figure 8:
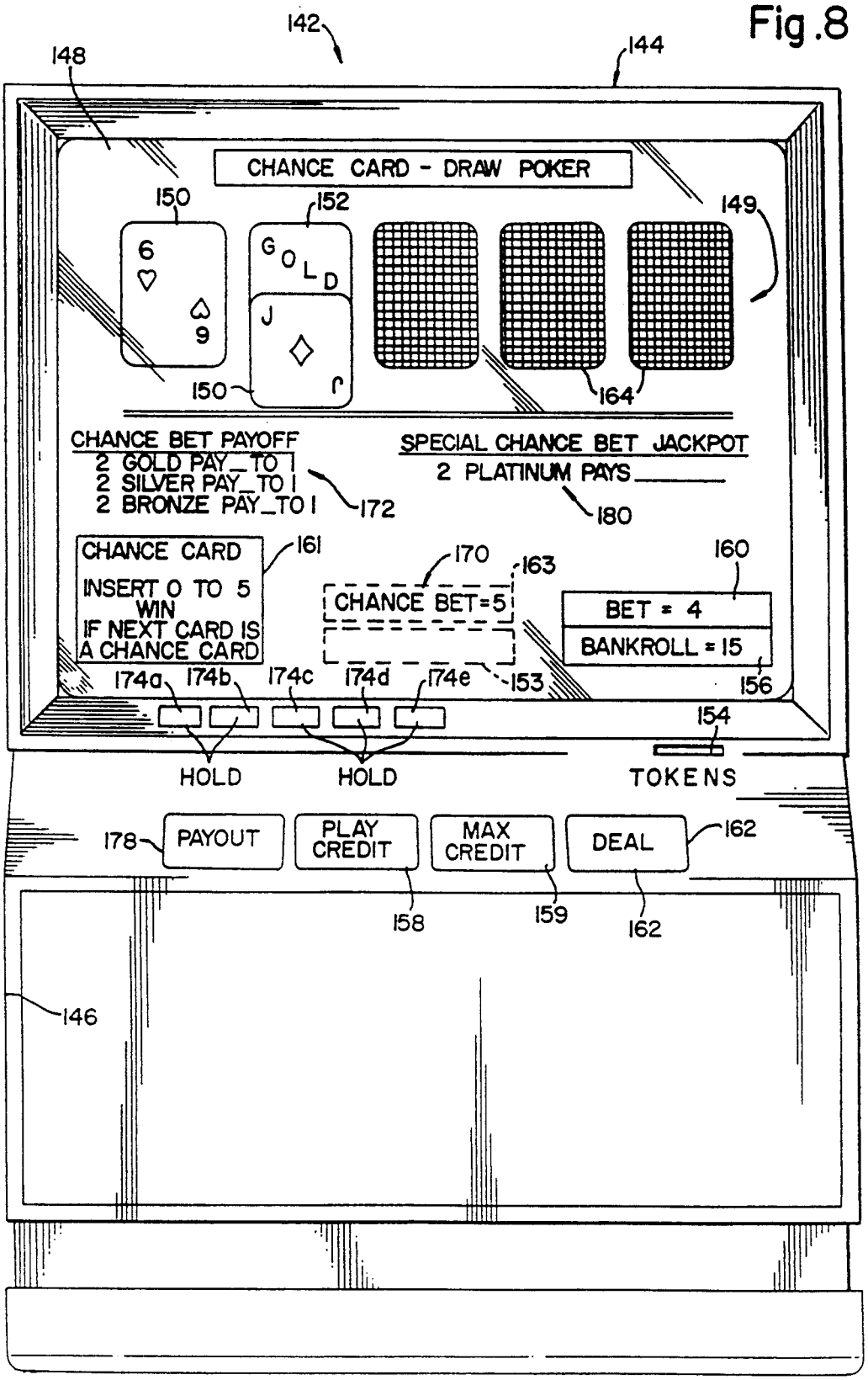
FIG. 8 is a front plan view of an electronic wagering game of the present invention.

Depicted in FIG. 8 is a playing system 142 which includes a display means 144. Display means 144 is an electronic game device 146 having a video display screen 148. In playing system 142, the object of the game is to obtain a poker hand shown in a hand display 149 of predetermined values which have predetermined payoffs. Thus, the usual symbols are representations 150 of usual playing cards of a deck. If desired, game device 146 can electronically mix a number of decks together, so that it is possible to even obtain five of a kind. In addition, a plurality of chance cards are also electronically mixed with the usual playing cards. In this embodiment, the chance cards come in four different colors, as shown by representation 152 of a gold card.

In order to play a hand with game device 146, the following steps are taken. Initially, in an attract mode after a hand has been played, the words "INSERT COIN" appears in an instruction area 153 of display screen 144. This is an invitation to feed from one to five tokens into game device 146 through suitable wager receiving means 154. After five tokens are received in wager receiving means 154, the game will automatically start. If it is desired to wager less than five tokens, then after the desired number of tokens are inserted in wager receiving means 154, deal button 162 is pressed to start the game.

Alternatively, if credits are already present in a suitable registering means including an indicia 156 on display screen 148 (which shows a "bankroll" credit of 15), one or more credits is transferred to usual bet indicia 160 by depressing play credit button 158 and then deal button 162. As shown in FIG. 8 in indicia 160 a usual bet of four credits has been made. For convenience, if it is desired to wager the maximum number of credits, five in this example, max credit button 159 is simply depressed to transfer five credits from bankroll indicia 156 and this also automatically starts the game. It should be appreciated that indicia 156 thus serves to indicate the number of credits left, and serves as an indication of winning wagers which are credited or registered to this bankroll.

After a hand of playing system 142 is initiated by placing a usual bet and pressing deal button 162 (if necessary), representations 164 of the backs of the cards in hand display 149 are turned over one after another to a usual card representation 150 (shown in the first spot) or a chance card representation such as gold card representation 152 (shown partially in the second spot). Conveniently, this proceeds from left to right automatically, unless a chance card is dealt (as shown in the second card dealt in FIG. 8).

When a chance card is dealt, an invitation (such as "CHANCE CARD — INSERT 0 TO 5 —  WIN  — IF NEXT CARD IS A CHANCE CARD — PRESS DEAL TO PLAY") to make a chance bet appears in instruction area 161. The player is then given an opportunity to place a chance bet in chance bet area 163 which then appears with the indicia "CHANCE BET". Where the player already has available credits as indicated in indicia 156, this is done by depressing either play credit bet button 158 a number of times as desired for the number of credits to be registered for a chance bet or by simply depressing max credit bet button 159 for an automatic bet of five credits. If no credits are available or an insufficient number, the player then simply inserts the desired number of tokens in wager receiving means 154.

Where max credit bet button 159 is depressed or five tokens are inserted in wager receiving means 154, a new card is immediately dealt on top of and somewhat below (i.e., overlapping) the chance card as shown. Otherwise, this action is instead initiated by depressing deal button 162 if play credit button 158 is used or less than five tokens are inserted into wager receiving means 154. If no chance bet is desired, then the player simply depresses deal button 168 without making any bet.

As shown in FIG. 8, a chance bet of five credits was registered by a suitable registering means including indicia 170, so that the next card was automatically dealt overlapping gold chance card 152. This next card was a usual playing card 150 (in this case the jack of diamonds). Consequently, instruction area 161 then displayed "SORRY — NO MATCH THIS TIME PRESS DEAL TO PLAY". Then, after deal button 162 is pressed, the usual playing card 150 will take the place of gold chance card 152 at the second spot and the loss of the chance bet as shown in chance bet area will occur as the chance bet indicia 170 disappears. The deal of the remainder of the cards 164 then continues, unless another chance card is displayed in which case the above steps are then repeated.

If a chance card of the same color had appeared, a payoff as indicated by indicia 172 would have been made. This would have been initially indicated by the words "CHANCE CARD — YOU HAVE A MATCH — PRESS DEAL TO PLAY". When deal button 162 was then pressed, the chance bet indicated in indicia would have disappeared and the appropriate number of credits would have been registered in the registering means and the new number of credits displayed in bankroll indicia 156. After this was accomplished, a new card would be dealt in place of the two overlapping chance cards in the second spot.

After five usual card representations 150 have been obtained, the player then has the opportunity to be dealt new cards for each one of the original five received. Each one of the cards represented in hand display 149 optionally held or replaced as desired by the player. This is conveniently indicated in instruction area 161 by the words "HOLD (0) TO (5) CARDS AND PRESS DEAL. OTHER CARDS WILL BE REPLACED". If it is desired to hold the card, the corresponding hold button 174*a*, 174*b*, 174*c*, 174*d*, and 174*e* is simply depressed.

After the desired selections are made, deal button 162 is simply depressed and the cards which are not to be held are replaced (dealt anew) one at a time is continued until all cards represented in hand display 149 have been held or dealt again. Obviously, any time that a card is dealt and that card is a representation 152 of a chance card, the process of providing an opportunity to make a chance bet is repeated. After the last card representation in hand display 149 has been held or dealt anew and the hand provided in hand display 149 is set, game device 146 determines the value of the hand in hand display 149. A payoff as indicated by suitable indicia appearing in instruction area 161 is then made, either by removing the bet total from bet indicia 160 or providing credits to bankroll indicia 156.

If the player desires to play again, a usual bet is then made to start a new hand. Otherwise, the player presses a payout button 178 and game device 146 makes a suitable payout such as by tokens or a receipt.

To further interest in chance betting for casinos and the like, a progressive chance jackpot can also be provided, such as indicated by indicia 180. The value for the progressive chance jackpot would preferably come from a percentage of each losing chance bet made on the particular game device, as well as other such game devices located in the casino. All of these game devices would be electronically connected together, and the increasing value of the progressive chance jackpot would be displayed in indicia 180. In order to win such a progressive jackpot, two platinum chance cards (not shown) could be added to the six or more decks of usual playing cards electronically mixed in game device 146. Then, a progressive jackpot would be won when the two platinum chance cards are consecutively dealt and a chance wager is made.

While various playing systems and variations have been described above, it will be appreciated that many of the variations of one playing system would be adaptable to others of the described playing systems. In addition, as obvious to those of ordinary skill in the art, numerous other playing systems besides those described above and in particular numerous other games could incorporate the basic methods of play and the various variations described.

Figure 9:
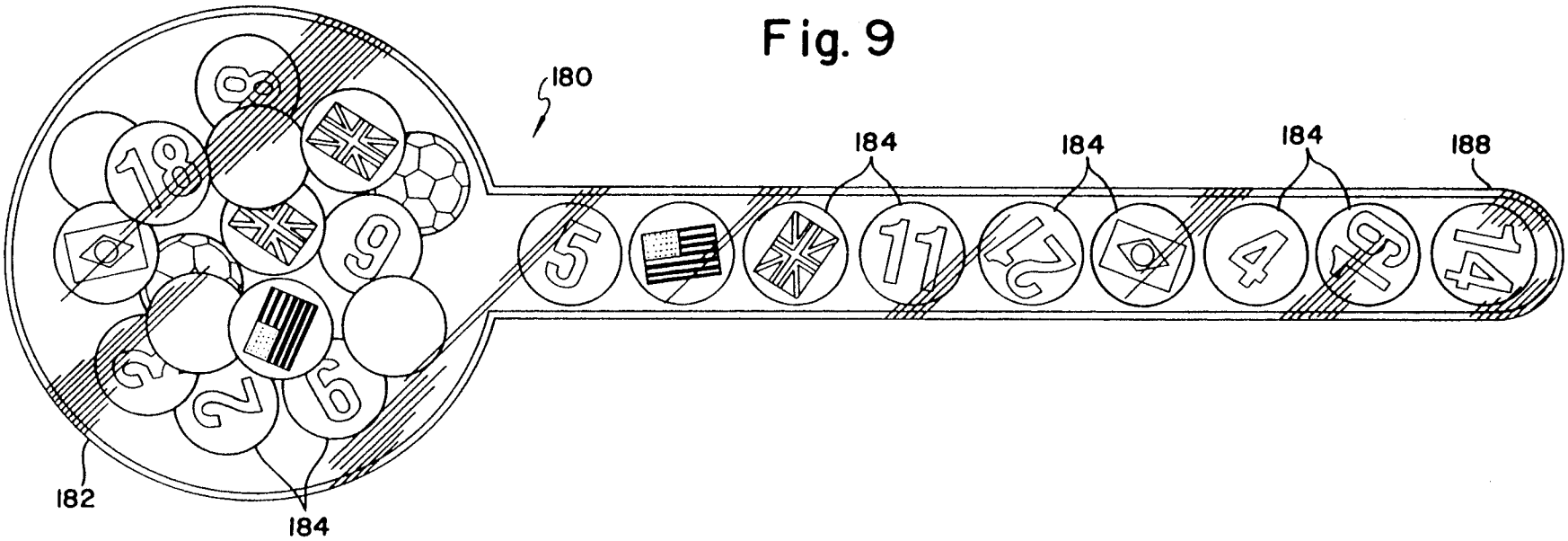
FIG. 9 is a schematic view of an air ball device for use in a lottery game in accordance with the present invention.

For example, various lottery games such as those where a predetermined plurality of numbers are selected could be adapted to incorporate additional chance symbols according to the present invention. Shown in FIG. 9 is a playing system 180 which is usable with such lottery games. Playing system 180 includes a mixing chamber 182 in which a plurality (such as fifty) of usual (value) balls 184 are mixed by blowing air, as well known in the art. In this embodiment, usual balls 184 have different indicia thereon, including numbers as well as flag symbols of different countries. Obviously, the choice of symbols used on usual balls 184 is arbitrary and is made for convenience or as desired by the lottery owner.

Added to usual balls 184 in mixing chamber 182 is one or more additional chance (no value) balls 186; in this embodiment three additional chance balls 186 are used. Chance balls 186 are designed to look like soccer balls. While the selection of the symbols for chance balls 186 is also arbitrary, it will be appreciated that balls 184 and 186 could be used in a lottery which would generate interest in countries interested in World Cup soccer or the like.

In use, playing system 180 is used to select a certain number of balls 184 and/or 186. Selection is accomplished by use of a transparent tube 188 which is selectively connected to mixing chamber 182, as also well known to those in the art. In this embodiment of playing system 180, the lottery winner is based on a player choosing six usual balls 184 of all of those selected. Thus, to assure that six usual balls 184 are selected (in case all three chance balls 186 mixed in with the various usual balls 184 are also selected), tube 188 must be capable of holding nine balls. Thus, tube 188 is considered as having nine slots to be filled with nine balls. It will be appreciated that all usual balls selected determine the lottery winner (or winners).

In FIG. 9, nine usual balls 184 have been selected, so that various combinations of six balls 184 would determine the lottery winner(s). The winner(s) would win a usual prize, determined in advance according to schemes well known in the art.

Figure 10:
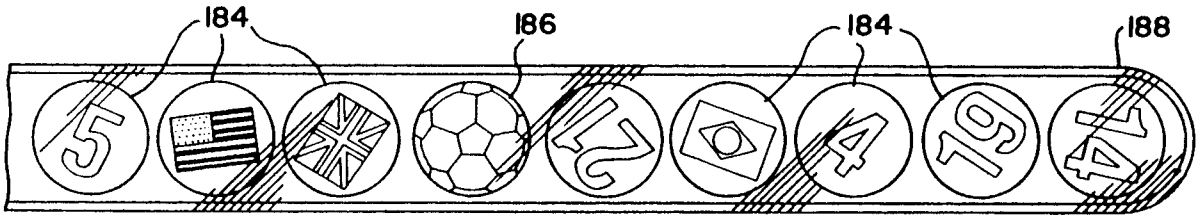
FIG. 10 is a schematic view of the tube portion of the ball device depicted in FIG. 9 with a different configuration of balls than in the FIG. 9.

In FIG. 10, while nine balls 184 and 186 have been selected, the group including the usual balls 184 includes a chance ball 186. In this situation, the choosing of any six of the usual balls 184 determines the lottery winner; and because a chance ball was included in this group, the winnings are (for example) doubled over that of the winner of the lottery when no chance balls are selected. However, it will be appreciated that the chances of a winner matching six of the usual balls is decreased, because there are only eight usual balls.

Figure 11:
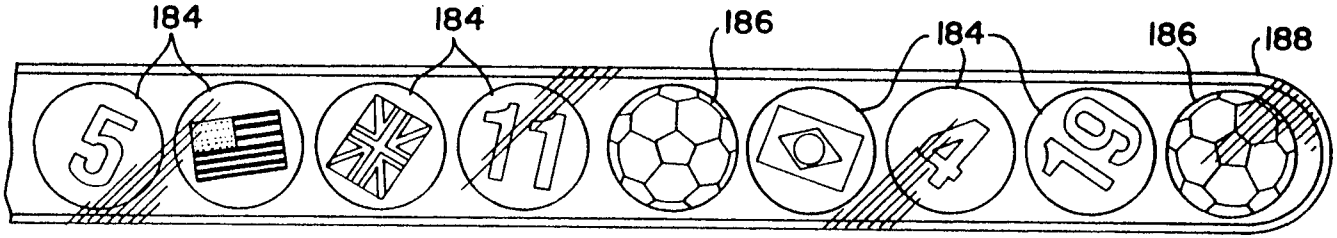
FIG. 11 is a schematic view of the tube portion of the ball device depicted in FIG. 9 with a different configuration of balls than in the FIGS. 9 and 10.

In FIG. 11, while nine balls 184 and 186 have been selected, the group including the usual balls 184 includes two chance balls 186. In this situation as well, the choosing of any six of the usual balls 184 determines the lottery winner. However, because the two chance balls 186 were included in this group, the winnings are (for example) five times that of the winner of the lottery when no chance balls 186 are selected (as the chances of a winner are further decreased).

Figure 12:
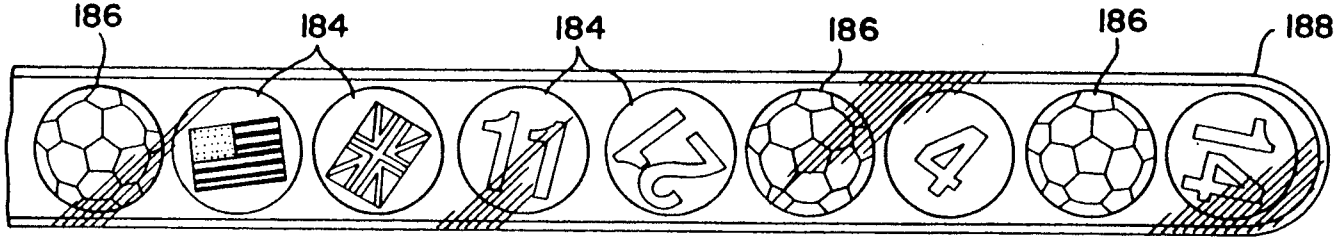
FIG. 12 is a schematic view of the tube portion of the ball device depicted in FIG. 9 with a different configuration of balls than in the FIGS. 9, 10, and 11.

In FIG. 12, the group including the usual balls 184 (four numbered and two flags) is the entire tube 188 as this group includes three chance balls 186. In this situation as well, the (and only) six usual balls 184 determines the lottery winner. However, because the three chance balls 186 were included in this group, the winnings are (for example) twelve times that of the winner of the lottery when no chance balls 186 are selected (as the chances of a winner are still further decreased).

While the winnings of the lottery using the six usual balls 184 has been described as being increased automatically whenever one or more chance balls 186 are selected, other variations are possible. For example, the lottery player could be required at the same time that the usual ticket is purchased to elect as well (if desired) for any chance payoff in accordance with whether there will be one (or more), two (or more) or three chance balls 186 in the selected group. A progressively increased purchase price would then be charged for each increased payoff chance, or a single increased price for any one of the chance selections.

As an alternative embodiment, chance wagers could instead provide an additional payoff where two no value (chance) balls are added to the usual balls and then selected during the course of selecting six (for example) numbered balls. This increased payoff could be made: for the selection of two no value balls consecutively, for the selection of two no value balls out of the total, or for both, with different payoffs for each possibility. It should be appreciated that where six numbers are required for a lottery bet, eight (six plus the number of chance balls) balls would be selected with the numbered balls determining the winning lottery combination. As an alternative, it could simply be decided that if two of the eight were also no value balls, the winnings could be doubled.

Figure 13:
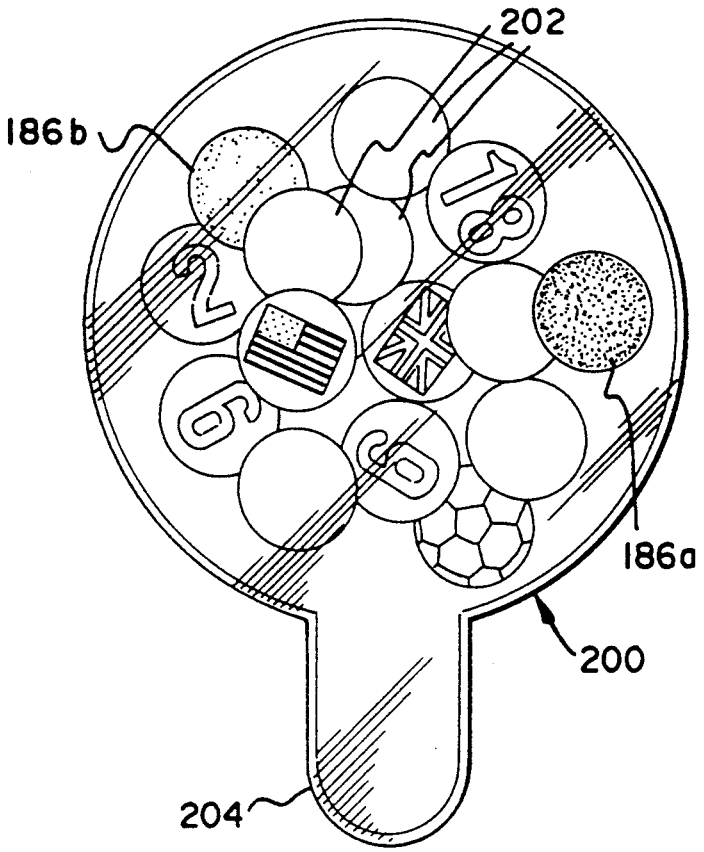
FIG. 13 is a schematic representation of an alternative air ball device for use in selecting only an additional ball for a lottery game in accordance with the present invention.

Depicted in FIG. 13 is an alternative selection means 200 used together with playing system 180 in an alternative method of playing a lottery type game as explained hereinafter. In this alternative lottery game, no chance balls are included in mixing chamber 182. Instead, selection means 200 is used to possibly select a chance ball 186*a* or 186*b* from among a plurality of plain balls 202 for positioning with the usual balls selected with mixing chamber 182, such as by a bypass door or the like (not shown) in tube 188. It will be appreciated that if desired there could be only a single chance ball 186 instead of two.

Broadly, the play of the lottery game is essentially the same as that discussed above with playing system 180. However, at some point in the selection process for the usual balls 184, selection means 200 is activated and a single ball is selected in tube 204 of selection means 200. Obviously, the odds for selecting either of chance balls 186*a* or 186*b* is small, and depends on the number of plain balls 202 contained in selection means 200. If a plain ball 202 is selected, the lottery game proceeds in the usual manner and nine usual balls 184 are selected by playing system 180 to determine the winner. However, if selection means 200 does select either chance ball 186*a* or 186*b*, then the selected chance ball 186*a* or 186*b* is inserted into tube 188 indicating that an increased payoff is in effect.

As shown in the drawings, chance balls 186*a* and 186*b* are differently designated. For example, chance ball 186*a* could be gold colored and chance ball 186*b* could be silver colored. Then, the increased payoff for the selection of gold colored chance ball 186*a* could be greater than the increased payoff if silver colored chance ball 186*b* is selected. By way of example, the increased payoff for selection of gold chance ball 186*a* could be triple the normal payoff, while the increased payoff for silver chance ball 186*b* could by only double the normal payoff. Obviously, there could be other or alternative chance balls as well with other increased (or even decreased) payoffs as desired.

For all of these lottery type games discussed above, the timing of the selection of the chance ball can be as desired. Thus, selection means 200 could be used before playing system 180 is used to select any usual balls 184 for the nine available slots in tube 188. In this case, it would immediately be determined whether there would be an increased payoff before any usual balls are selected. Alternatively, selection means 200 could be used at any time during the individual selection of the usual balls 184. Selection means 200 could even be used after all nine usual balls 184 have been selected. However, it will be appreciated that if a chance ball 186*a* or 186*b* were selected, one and preferably the last, usual ball 184 selected would then be discarded and chance ball 186*a* or 186*b* put in the discarded usual ball 184 slot. Ordinarily, the removal of a selected usual ball 184 would be considered undesirable, but there could be variations of games of this type where this would not be undesirable — such as some sort of elimination game where a player loses if selected number(s) are chosen, so that the selection of the chance ball would increase the chances of not being eliminated.

The selection of the usual balls 184 could also be conducted in stages if desired. For example, the selection of the usual balls 184 could occur at different times, if this would increase interest or allow for subsequent participation. The selection of the usual balls 184 could also be made from two or more playing systems, for example one containing half of the usual balls 184 and another containing the other half — with the chance balls added to one or the other or both, or to a separate selection means such as discussed above.

The position of the slot in tube 188 which a selected chance ball occupies could also be used to determine the increased payoff or extent of the increased payoff. For example, if the chance ball is selected first, the payoff could be doubled; while if selected last it could be ten fold. Other variations of this would obviously be possible. Thus, using selection means 200, it would further be possible to have two separate drawings therewith to see if a chance ball is selected to fill the first spot, and if a chance ball is not selected then, a later drawing to see if a chance ball is selected to fill the last spot.

Obviously, other variations of lottery games consistent with the description of the various playing systems above could also be possible, and other lottery games could be similarly adapted. Similar games such as bingo and keno could likewise be similarly adapted as desired. Numerous other apparatuses for selecting of the lottery symbols could additionally be used consistent with the present invention. Further, besides flags for symbols, to be used in addition to numbers or in lieu of numbers, various other symbols are possible such as to be used with a video poker or keno game. Still further, besides a soccer ball designation for a chance symbol, other symbols having a different significance are possible, such as a state symbol for use in a state lottery (e.g., a peach for GA, an orange for FL, or an apple for NY).

Other examples of playing systems and games which could make use of the various methods of play and variations described above include reel slot devices, video games (using multiple screens if desired for some embodiments), lounge games, and television or other game shows.

Thus, while the present invention has been described with respect to exemplary embodiments thereof, it will be understood by those of ordinary skill in the art that variations and modifications can be effected within the scope and spirit of the invention.

What is claimed is:

1. A method of playing a lottery-type wagering game whose outcome is determined by a random selection of a plurality of winning lottery symbols from a game set of lottery symbols of that game comprising the steps of:

adding at least one additional element to the game;

playing of the game by at least one player, including the steps of selecting a player set of player symbols from the game set of lottery symbols by the player which player set contains less player symbols than a predetermined plurality of winning symbols to be selected, wagering a wager on a play of the game by the player that a predetermined plurality of the player symbols of the player set will match the predetermined plurality of winning symbols to be selected and subsequent to said wagering step, randomly selecting the predetermined plurality of winning symbols including a plurality of winning lottery symbols selected from the game set of the lottery symbols and, potentially, the additional symbol which is possibly selected by use of a selection means for randomly selecting the additional symbol from a plurality of other symbols such that the selected plurality of winning symbols may or may not include the additional symbol; and settling of the wager at one of a) a first payoff if the additional symbol is not selected and a predetermined plurality of the player symbols of the player set match the selected winning lottery symbols and b) a second payoff if an additional symbol is selected and a predetermined plurality of the player symbols of the player set match the selected winning lottery symbols.

2. A method of playing a wagering game as claimed in claim 1 wherein said adding step includes the adding of second additional symbol different from the first-mentioned additional symbol.

3. A method of playing a wagering game as claimed in claim 2 wherein said settling step for the second payoff includes the settling of the wager at different payoffs depending on which one of the two different additional symbols is selected.

4. A method of playing a wagering game as claimed in claim 1 wherein the plurality of winning symbols selected are arranged in a corresponding series of spots provided in a predetermined order; and wherein said settling step for the second payoff includes the settling of the wager at different payoffs depending on which one of the ordered spots is filled with the additional symbol.

5. A method of playing a wagering game as claimed in claim 1 wherein said adding step includes the adding of the additional symbol to the game set of lottery symbols for possible selection concurrent with the lottery symbols.

6. A method of playing a wagering game as claimed in claim 1 wherein said adding step includes the adding of the additional symbol to a separate selection means containing other symbols from which the additional symbol may be randomly selected separate from the lottery symbols.

7. A method of playing a wagering game as claimed in claim 1 wherein the lottery symbols include numbered balls and the additional symbol is a non-numbered ball.

8. A method of playing a wagering game as claimed in claim 1 wherein the participants of the game include at least one player and a house against which each player wagers; and wherein the settling step is performed by the house.

* * * * *